US012635800B2

(12) United States Patent
Richards

(10) Patent No.: US 12,635,800 B2
(45) Date of Patent: May 26, 2026

(54) SEAT MOUNTABLE DIGITAL DISPLAY ASSEMBLY AND MOUNTABLE HOLDER ASSEMBLY FOR BEVERAGES AND ACCESSORIES WITH DIGITAL DISPLAY

(71) Applicant: Moving iMage Technologies, Inc., Fountain Valley, CA (US)

(72) Inventor: David Richards, Costa Mesa, CA (US)

(73) Assignee: Moving iMage Technologies, Inc., Fountain Valley, CA (US)

( * ) Notice: Subject to any disclaimer, the term of this patent is extended or adjusted under 35 U.S.C. 154(b) by 147 days.

(21) Appl. No.: 18/485,733

(22) Filed: Oct. 12, 2023

(65) Prior Publication Data

US 2024/0122357 A1 Apr. 18, 2024

Related U.S. Application Data

(60) Provisional application No. 63/415,510, filed on Oct. 12, 2022.

(51) Int. Cl.
*A47C 7/72* (2006.01)
*A47C 7/62* (2006.01)

(52) U.S. Cl.
CPC ..... *A47C 7/723* (2018.08); *A47C 7/622* (2018.08)

(58) Field of Classification Search
CPC ..... A47C 7/723; A47C 7/622; G09F 23/00; G09F 2023/005
USPC ..... 297/217.3; 40/320
See application file for complete search history.

(56) References Cited

U.S. PATENT DOCUMENTS

| | | | | |
|---|---|---|---|---|
| 5,938,091 | A * | 8/1999 | Bergin | B62B 3/1472 224/526 |
| 6,457,772 | B1 * | 10/2002 | Forston | A47C 7/62 297/188.2 |
| 7,681,346 | B2 | 3/2010 | Bruce | |
| 8,441,779 | B2 | 5/2013 | Floros | |
| 8,955,242 | B2 | 2/2015 | Bruce | |
| 9,032,651 | B2 | 5/2015 | Bruce | |
| 9,824,611 | B2 | 11/2017 | Bruce | |
| D820,050 | S | 6/2018 | Bergin | |
| 10,633,911 | B2 * | 4/2020 | Edelman | A47C 1/143 |
| 2019/0014935 | A1 | 1/2019 | Bergin | |
| 2020/0153259 | A1 * | 5/2020 | Bober | H02J 7/02 |
| 2020/0320911 | A1 | 10/2020 | Bruce | |
| 2021/0401164 | A1 * | 12/2021 | Cass | A47C 17/86 |

FOREIGN PATENT DOCUMENTS

| | | | | |
|---|---|---|---|---|
| DE | 102021112671 B4 * | 8/2024 | | A47C 7/622 |

* cited by examiner

*Primary Examiner* — Milton Nelson, Jr.
(74) *Attorney, Agent, or Firm* — Westman, Champlin & Koehler, P.A; Z. Peter Sawicki; Amanda M. Prose

(57) ABSTRACT

A mountable digital display with optional holder assembly. The unit has a digital display integrated therein and includes a combination holder that is a beverage container holder, and a mobile device holder. The assembly is mountable in a space between adjacent seat backs in a venue such as a stadium or arena. The assembly without a combination holder may be mounted directly to a seat back of each seat in the venue.

6 Claims, 5 Drawing Sheets

SEAT MOUNTABLE DIGITAL DISPLAY ASSEMBLY AND MOUNTABLE HOLDER ASSEMBLY FOR BEVERAGES AND ACCESSORIES WITH DIGITAL DISPLAY

CROSS-REFERENCE TO RELATED APPLICATION

This application claims priority to and the benefit of U.S. provisional patent application Ser. No. 63/415,510, filed Oct. 12, 2022, the contents of which are incorporated herein in their entirety.

BACKGROUND

The present invention relates to a mountable holder assembly. More specifically, the present invention relates to a combination digital display and holder assembly for a beverage container and multiple accessories.

Sports facilities, concert venues, and other public performance venues include beverage container holders attached to seat backs. Patrons must set their other items on their laps or on the floor, which may be dirty from foot traffic or sticky from spilled drinks and snacks. It is common for these patrons to ask a companion to hold their drink, their phone and/or their purse as there is no place to store these items without leaving them on the floor near their seat.

These facilities and venues also generally rely on advertising from sponsors for additional revenue. These advertisements generally appear in digital form on score boards or displays secured to walls and the backs of bathroom doors.

SUMMARY

An aspect of the present disclosure relates to a mountable combination holder assembly. The assembly includes a main body having a first cavity integrally formed therein and configured to hold a beverage container in a substantially upright position; a second cavity integrally formed therein and configured to hold an accessory therein; an opening in the main body for supporting a digital display thereon and one or more transmitters within the main body operably connected to the digital display and positioned within an interior of the main body behind the digital display, wherein the main body is mountable to a seat back with a surface of the main body configured for mounting to at least one seat back.

The digital display comprises an e-paper based display.

The main body portion is a molded plastic main body.

The one or more receivers comprise an RF receiver, an IR receiver, or a combination thereof.

The digital display is positioned on a top surface, side surface, front surface, or combination thereof on the main body.

The first and second cavities are positioned on the top surface of the main body.

Another aspect of the present disclosure relates to system for providing updateable digital displays to each seat in a plurality of seats in a stadium. The system includes a plurality of combination holders, each comprising a main body mountable to a seat back of a seat and the main body supporting a digital display, a first cavity for holding a beverage, a second cavity for holding an accessory, and a first receiver; a central controller configured to communicate with each of the plurality of combination holders to provide text for each digital display; and one or more transmitters for directing signals from the central controller to each receiver in the main body display.

The central controller is configured to communicate with the one or more receivers by a wired or wireless network connection.

The first receiver of each combination holder is programmed to check-in with one of the one or more receivers on a pre-set schedule.

The pre-set schedule comprises a variable frequency of check-ins, wherein the frequency is hourly, daily, weekly, or a combination thereof.

The plurality of combination holders comprises up to 20,000 combination holders in communication with the central controller and 4 or more second receivers or transmitters.

The digital display is an e-paper based display, LED display, or a combination thereof.

Yet another aspect of the present disclosure relates to a mountable display assembly. The assembly includes a digital display housing with a digital display panel visible through an opening in the housing and supporting electronics for the digital display assembly provided within the housing; a transparent plastic cover provided over the digital display panel, and wherein the housing is sealed housing such that the digital display housing is a module that is mountable to a seat in a row of seats in a venue.

In one or more embodiments, the assembly also includes a separable accessory frame wherein the accessory frame comprises one or more surfaces for holding items including a cup holder and a mobile phone holder.

The digital display housing is connectable to the accessory frame forming a combination display and holder and wherein the combination display and holder are mountable to the seat in a space between adjacent seats in the row of seats.

In one or more embodiments, the digital display housing and digital display panel are curved and are configured for mounting directly to a curved seat back portion of the seat.

The digital display panel is battery powered and the battery is provided within the module housing or externally attached thereto.

A plurality of assemblies is provided and each assembly in the plurality of assemblies is mounted to the seat in a row of seats.

A charge storage module is provided for the row of seats wherein the charge storage module comprises an IR receiver and a battery for the plurality of assemblies.

A flat cable for connecting each of the assemblies in the plurality of assemblies in the row to the charge storage module and configured to provide power and data to the assemblies in the row is also provided.

DETAILED DESCRIPTION

Figure 1:
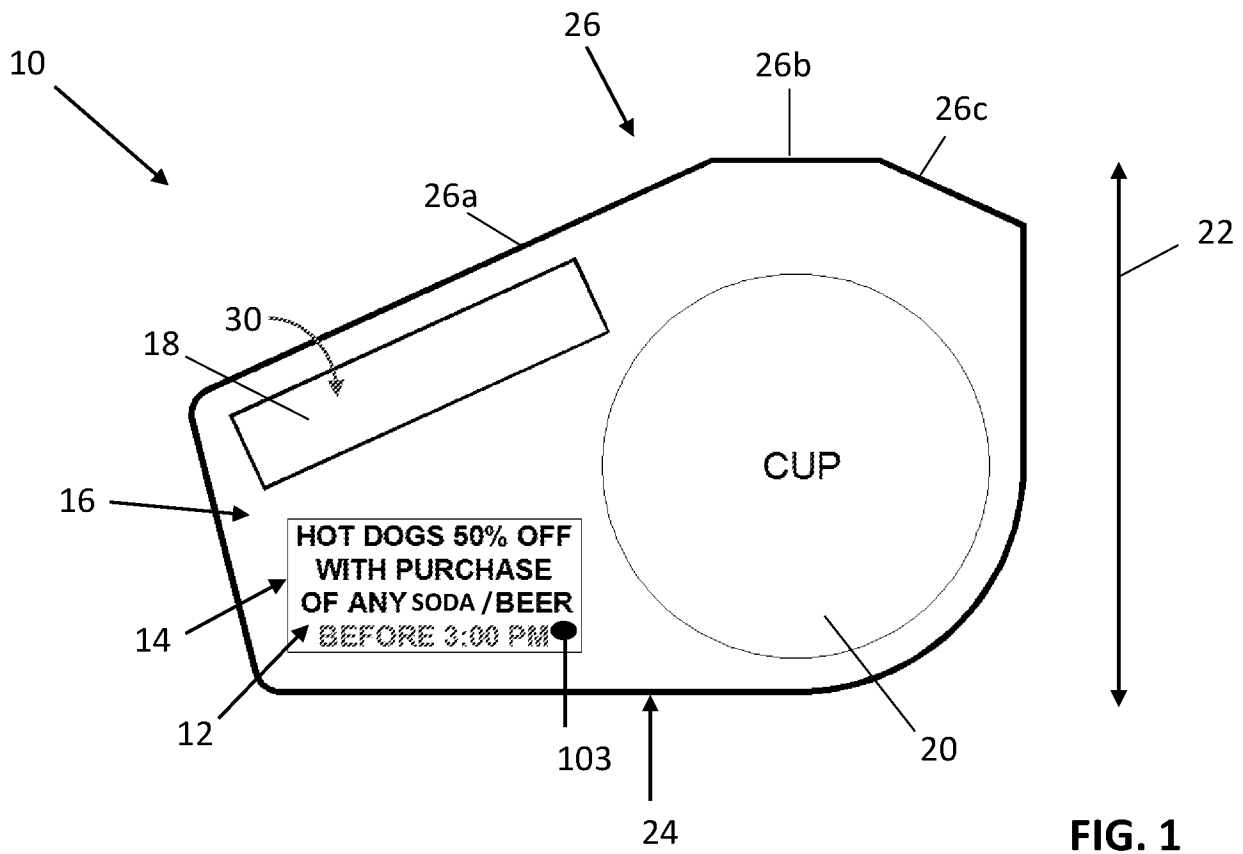
FIG. 1 is a top view of a holder and digital display according to embodiments disclosed herein.

A mountable holder and/or display assembly described herein can be installed in seating arrangements existing in stadiums, sports arenas, amphitheaters, and other venues as well as facilities or venues of this type in a planning phase and/or under construction. Thus, the mountable holder and/or display assembly can be a retrofit device for installation in venues of varying size including multi-thousand seat venues as well as an attachment for new seating installations during construction.

The holder and/or display assembly provides owners and operators of these facilities with individual and selectively changeable advertising at every seat in the facility. The content of the digital display can include announcements, advertisements, information relating the current event occurring at the facility and future events, performer information, trivia contests, or other interactive content. The content on the digital display can be revolving or static. For example, the content of the display can be selectively updated at various frequencies, such as once per hour, twice per hour, daily, or more frequently.

A holder and display assembly can be mounted in the space between each set of adjacent seat backs, which may be described as a triangular area where adjacent seat backs meet. In one embodiment, the assembly has a main body that is configured with a back surface having dimensions that allow the main body to fit within the space between the adjacent seat backs and mount to one or both adjacent seat backs. The dimensions of the main body are also sufficient to hold beverage containers of various sizes while not protruding into the space between a row of seats and the seat backs to the row of seats directly in front thereof in a manner that blocks passage through the space between the rows of seats.

A holder and display assembly may alternatively comprise a digital display module and a cup and/or accessory holder frame. That is, the assembly comprises a sealed digital display module where a housing supports the electronics for the digital display and the display is mounted for viewing through an opening in the module. The digital display itself may then be further provided with a transparent cover for protection and for maintaining the module as a sealed unit. The cup and/or accessory holder is provided as a frame that may securely couple to the digital display module. For example, the module and the cup/accessory holder frame may connect via a snap fit or other frictional engagement. The coupling of these components may be secure and thus removable only with a specialized tool for release of a tab or other holding element.

The display assembly may be a digital display assembly integrated into the holder or into a housing of the digital display model. In one or more embodiments, the display assembly can be a micropower display, e-paper or TFT LCD memory-in-pixel display. The size of the display itself may vary, as well as the shape. For example, the display may be a rectangular display with dimensions ranging from about 2 to about 4 inches or more measured on the diagonal.

In one or more embodiments, the digital display module may be provided as a mountable module that can be mounted to a seat back without the cup and/or accessory holder frame. In such an embodiment, the digital display module is a sealed housing comprising the electronics and power components for the digital display. The digital display and module housing may be curved along one or more of the length or height and/or flexible along one or more of the length or height so that the digital display and module can be mounted along a surface of the seat back itself and follow the curvature of the seat back.

The digital display according to one or more embodiments described herein can be a battery powered display or alternatively the display may be wirelessly powered, IR powered, or FR harvest-powered. A control system can be provided to connect, power, and/or control multiple holder and display assemblies. For example, the control system may be configured to support up to 50,000 or more assemblies, such as when a plurality of assemblies are provided, one to each seat of a stadium or area.

Figure 2:
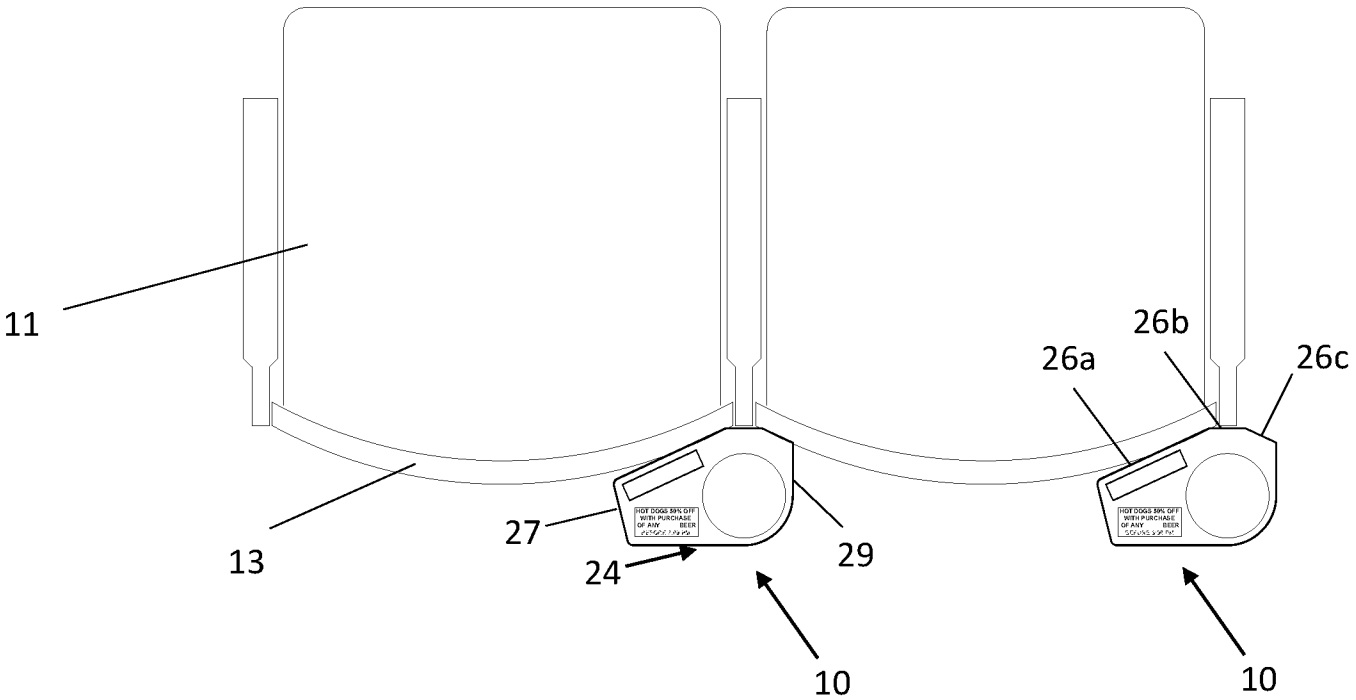
FIG. 2 is a top view of the holder and digital display installed in sports arena seating.

In one embodiment, a mountable holder assembly 10 with digital display 12 is illustrated generally at FIGS. 1-2. The mountable holder assembly 10 comprises a digital display 12 and is a combination holder, where the digital display 12 is provided on a surface of the combination holder and may otherwise be integrated with the combination holder 16 of the assembly 10. In the embodiment illustrated, the digital display 12 is an e-paper based digital display where the content displayed may be rotating advertisements, informational materials or other announcements. The combination holder is a main body 16 that also includes an aperture that may be a holder 20 for a beverage container, also referred to herein as a cup holder and a slot opening that may be a holder 18 for a mobile device or other accessory.

The assembly 10 is mountable to a space between seats in a stadium. For example, seats in a stadium or other venue seating have curved seat backs. A triangular shaped cavity is formed at the edges of adjacent seat backs and the assembly can be mounted to one or both seat backs and at least partially within the cavity.

The assembly 10 and main body 16 may be constructed of a molded plastic. The holders 18 and 20 are then integrally formed within the main body 16. An opening 14 in the main body 16 provides a space for the digital display 12. In the embodiment illustrated, the digital display 12 is located on a top surface of the main body 16 for high visibility in situ, however it is also contemplated and within the scope of this disclosure that the display 12 may be located on a front and/or side of the main body 16. It is also contemplated that the display 12 and corresponding electronics are provided in a sealed housing separable from a frame for the holders 18 and 20 as discussed further below.

The main body 16 may also be substantially hollow inside such that an open space is provided within the main body 16 and the main body 16 is configured to receive components of the digital display 12 therewithin and optionally a battery and/or other equipment for powering and/or controlling the digital display 12 and the communication between the digital display 12 and a control system therefor.

As illustrated in FIGS. 1-2, the main body 16 supports an opening 14 therein for the digital display 12 mounting, an integral cup holder 20 and integrally formed mobile device holder 18. While a beverage container or cup holder and mobile device holder are disclosed herein, holders for other accessories are within this disclosure and the holder may be used to hold or retain objects of any shape capable of being received by one or more of the holders 18, 20.

The main body 16 has a vertical height and depth 22 that extends from a front face 24 of the main body 16 to a back face 26 of the main body 16. The back face 26 of the main body 16 has one or more surfaces 26*a*, 26*b*, 26*c* which are angled with respect to one another and provide one or more mounting surfaces to the main body 16 which allow the main body 16 to be mounted in the generally triangular space between curved seat backs 13 of two adjacent stadium or arena style seats 11 as illustrated in FIG. 2. The height and the depth of the main body 16 may vary, but are sufficient to accommodate a cavity for the holder 18 and a cavity for the holder 20.

The beverage container or cup holder 20 is an integrally formed cavity 20 extending downwardly into the main body 16, from an upper surface of the main body 16. The cup holder 20 may be positioned generally to one side of the main body or otherwise offset from a center of the main body 16. The slot 18 for receiving and supporting a mobile device such as a cell phone may be positioned at an angle parallel to back side segment 26*a* and opposite the cavity 20. The position of the holders 18 and 20 and side walls 27 and 29 allow the assembly 10 to be installed on a right-hand side of an end seat in a row of seats 11 or to a single seat 11 in a manner that does not obstruct aisle traffic passing the end or single seat.

The cup holder 20 extends downwardly into the main body 16 such that that a substantially circular wall formed within the main body 16 provides a perimeter to the cavity for the cup holder 20. This wall may be tapered to support a beverage container or a cup in a substantially upright position. A floor may be provided to the cup holder 20 to support beverage containers of different dimensions within the cup holder 20 in a substantially upright position. The floor may comprise one or more supports such that the floor has apertures therein. This allows for drainage of condensation from cold or hot beverage containers and allows for easy cleaning of the cup holder 20.

The holder 18 for holding a mobile device or cell phone is a slot also integrally formed within the base portion 16 and also extending downwardly from the upper surface of the base portion 16. The holder 18 may be a rectangular opening with a floor 30 and a perimeter wall which define the shape of the holder 18 and also support the device received therein in a substantially vertical position. While the holder 18 is described as generally rectangular in shape, other shapes may be utilized.

The holders 18 and 20 are integrally formed and may be formed when the main body 16 is molded. The opening 14 for the display 12 may also be integrally formed to provide a mount for the display screen 12 in the main body 16. The walls of each holder 18 and 20 may be spaced apart, meaning that overall, the base portion 16 is hollow in the area between the walls of each holder 18 and 20 thus reducing the weight of the combination holder 16 and for ease of manufacture and also allowing for operational components of the digital display 12 to be retained within the main body 16.

The back surface 26 of the main body 16 provides a perimeter mounting surface, which is adapted with a connection mechanism for securing the main body 16 to seat backs 13 of adjacent seats 11. The connection mechanism may comprise apertures configured to receive fasteners, such as screws, for mounting the main body 16 in an upright and level orientation with respect to a floor surface. While screws are disclosed herein as a mechanism for securing the main body 16 to the mounting surface, other fasteners may be used. Adhesives may also be used to secure the main body 16 to the mounting surface.

In one or more embodiments, the digital display and electronics associated therewith are provided in a sealed module or housing. The module may then be secured to a cup holder frame. The frame that supports the cup holder 20 and accessory holder 18 may couple to and/or around the digital display module. For example, the digital display module may "snap" into a molded cupholder and accessory holder frame body, in a semi-permanent manner with a latching ramp. The digital display module will be able to be removed for service or replacement using a tool configured to release the latching ramp from connection with a surface of the module.

Figure 3:
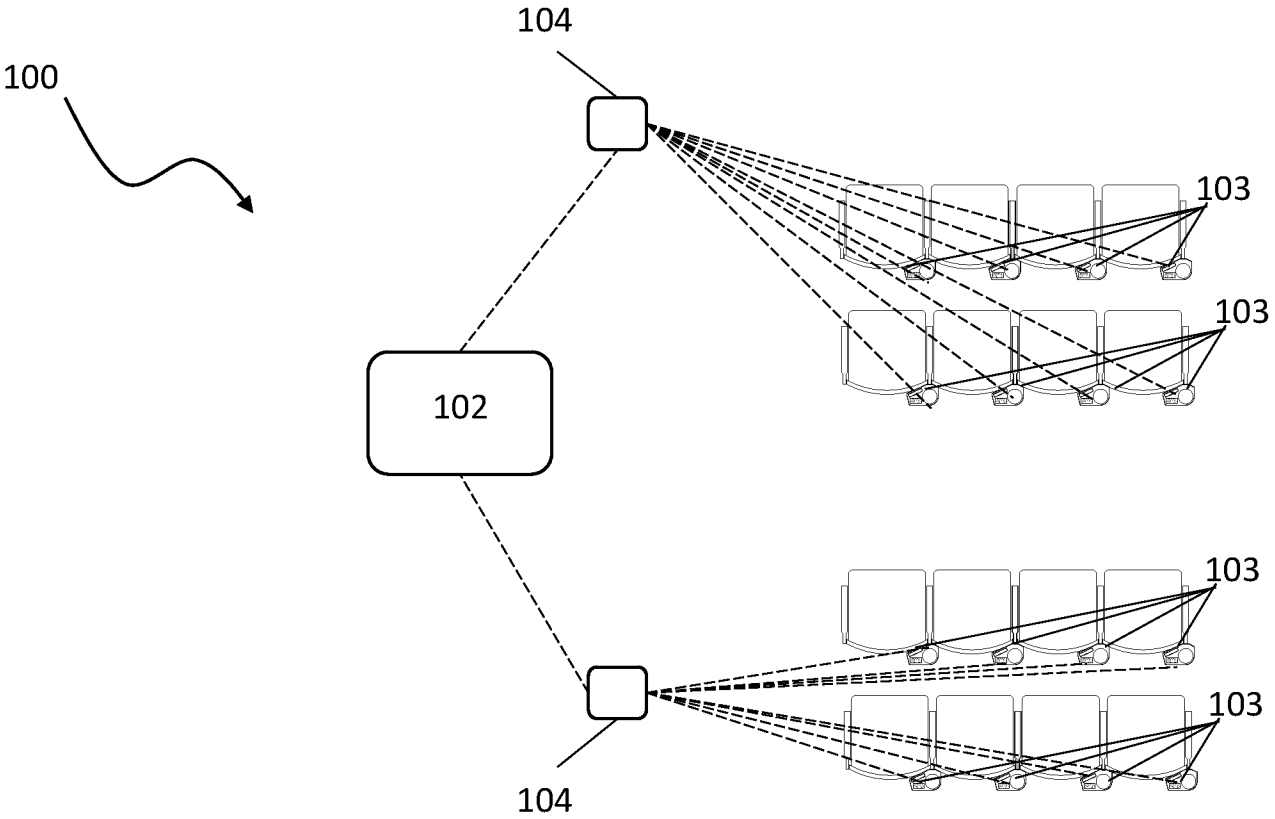
FIG. 3 is a schematic view of a combination holder and digital display system.

In one or more embodiments described herein, a plurality of assemblies 10 are installed in a venue as a combination beverage holder and display system 100 as illustrated in FIG. 3. The system also comprises a central controller 102 for communicating with the plurality of assemblies 10 and digital displays 12.

The central controller 102 is configured to control each display 12 that is installed in the venue. The system 100 further comprises a plurality of transmitters 104 that may be positioned around the venue. The central controller 102 may be located anywhere convenient such as an announcer booth, lighting and sound control room or other remote location. The central controller 102 is configured to communicate with all the transmitters 104 by network connection whether wired or wireless. For example, each transmitter 104 may have a network cable connecting the transmitter directly to the central controller 102 or be capable of connecting to the central controller 102 via Bluetooth, WiFi, or other network.

The content on the digital display 12 may be updated using a micropower radio transmission standard, referred to as LoRa or LoRaWAN. Each display unit 12 can be programmed to check in with the nearest radio transmitter on a selected or pre-set schedule, for example, the check-in may be set to occur hourly, daily, weekly, or can be arranged to skip several days if there are no events in the venue, and resume checking in again closer to a start time for an event. The display unit 12 of each holder 10 can be set to "radio silence" mode between the scheduled check-in times, which allows the holders 10 to conserve power. The control system can then be configured such that the control system provides a signal to each connected display device 12 which advises it there is an update for the ad display, and if it does, it pushes a signal with data for the content of the display text to the display 12. A transmitter/receiver 103 is provided to each display device and may be positioned within an interior of the main body 16.

An additional operational mode of LoRaWAN is able to support multicasting to many receivers simultaneously. The system according to one or more embodiments described herein may incorporate both operational modes of the LoRaWAN and allow for switching therebetween.

For digital display 12 content being updated, the system 100 may require a plurality of LoRa transmitters. For example, 4, 6, 8 or more radio transmitters spaced apart around the venue to cover all seating areas. Each digital display may be configured to only use power when the display 12 is being updated or changed in order to extend battery life.

As discussed previously above, the digital displays 12 and associated radio receiver in the main body is powered by a battery. The battery may be single use disposable battery or a rechargeable battery chargeable via wireless IR energy transmission system. In a system 100 wherein wireless energy transmission is used for charging the battery, this transmission is generally a line-of-sight transmission with a range of approximately 30 feet, so the system 100 would require a plurality of IR emitters mounted throughout the venue on various surfaces therein. In such a system there is a plurality of IR emitters significantly greater than the number of radio transmitters required for such a system 100.

It is also contemplated that IR harvesting receivers may be located at ends of rows of seats 11, the number of total IR receiver units required for large venues is then significantly decreased.

For battery replacement the main body 16 may be equipped with a removeable cover on a bottom side or other surface of the main body 16 in order to facilitate access to the interior of the main body. Alternatively, the digital display 12 may be removable from connection with the opening 14 of the main body 16 for access to the interior of the main body 16.

The system 100 may include a radio-based digital display 12 message delivery system, and a separate IR energy delivery system. The radio system may be configured to only deliver the content of the digital display messages to the digital display 12 and the IR system configured only to deliver operational power. Each system requires its own transmitters. For example, if a venue has the IR power for the display, the assembly 10 will have both a radio frequency transmitter for the digital display 12 message data, and an IR emitter for the power delivery. If a venue does not have IR power delivery, the assembly 10 will only require the RF radio transmitter for the digital display 12 data. It is also contemplated that the IR power delivery may be used in one embodiment of the assembly 10 to allow for charging of cell phones or mobile devices held in the assembly 10.

In one or more embodiments, the assembly 10 comprises a sealed module digital display with cup and accessory holder frame may comprise an e-paper display, primary battery that may be a disposable battery, and each assembly 10 being individually addressable by the controller 102. For example, the digital display may be a tri-color display (white, black, red), and the display having a length on the diagonal of approximately 2.9 inches. The battery may be positioned outside of the sealed display module to allow for service or may be provided inside the module along with the electronics components. In the embodiment wherein the battery is provided within the sealed module, the entire electronics module is replaceable via maintenance services. The display and electronics module may then snap fit, or otherwise couple into the molded cupholder frame in a tamperproof arrangement, such that specialized tools is required to remove the display module.

Figure 4:
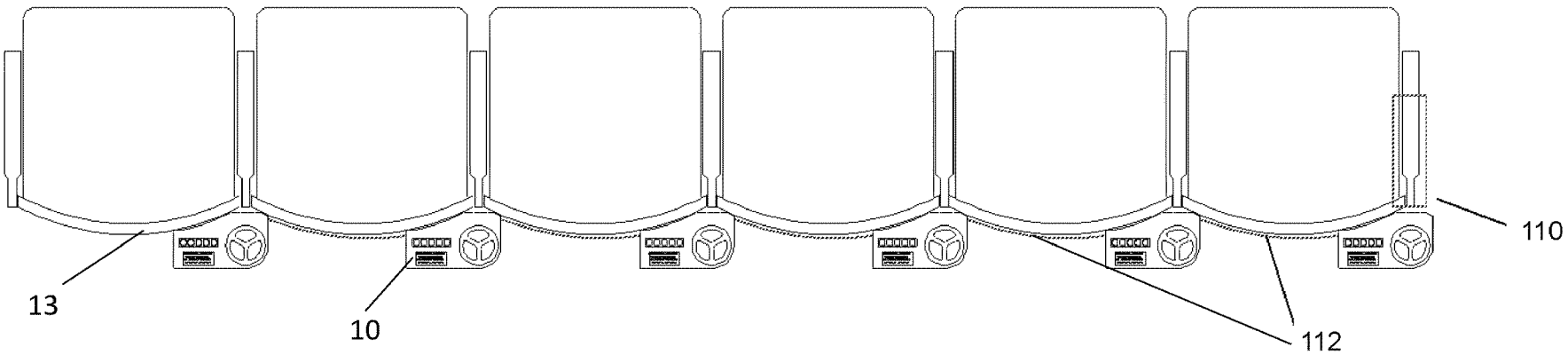
FIG. 4 is a top view of a second embodiment of an installation of the holder and digital display in arena seating.

Additionally, or alternatively, in one or more embodiments, the digital display module and cup holder frame assembly 10 is provided with a rechargeable battery that is charged by a larger battery 100 or battery array provided, for example, at an end of a row of seats 11 each supporting a digital display assembly 10 as illustrated in FIG. 4. In such an embodiment, a flat cable 112 is run across the backs of the seats in the row to connect all of the digital displays in the row together. In one or more embodiments, the display module may further comprise an external DC power input jack.

Additionally, or alternatively, in one or more embodiments, the digital display module and/or cup holder frame may be further provided with a port for device or phone charging. A display module and cup holder frame according to any one or more embodiments described herein may be provided with a QI coil to support phone charging, wherein the QI coil may be provided in a surface of the accessory holder 18 to support charging of the phones. A wireless power transmission receiver may be provided at the end of the row as illustrated in FIG. 4. A local battery may then be provided in each holder 18, where the local battery may then be charged during times of non-use, such as overnight, with power from the larger battery at the end of the row. It is also contemplated and within the scope of this disclosure that additional battery charging may be provided to the end-of-row battery unit from a portable charger cart.

Figure 5:
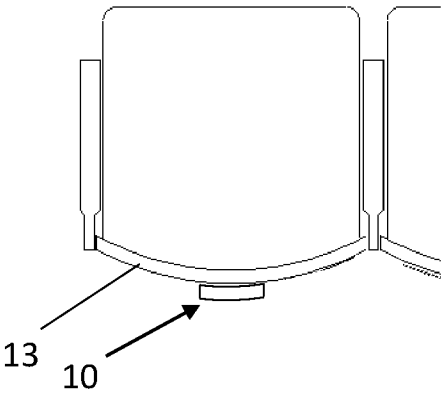
FIG. 5 is a top view of an additional embodiment of a digital display system without a holder assembly.

Additionally, or alternatively, in one or more embodiments, a digital display may be a seat back digital display installed without a cup holder unit or frame as shown in FIG. 5. The digital display 200 is mountable to a seat back 13 in a location that may be approximately centered and near a top or upper portion of the seat back. An e-paper display and a housing therefor may be curved to follow and/or fit the curvature of the seat back, or the display and housing therefor may be sufficiently flexible to conform to the curved seat back location as a seat back radius of curvature may vary by venue and/or by section of seats in a single venue. A transparent, high impact strength plastic material, such as polycarbonate (Lexan™) cover may be provided over the display screen to protect the e-paper surface impact such as kicks, bumps, or impact from attendee movement and baggage in any one of the embodiments described herein. The electronics for the digital display may be similar to those of one or more embodiments described herein. In one embodiment, a 7-color e-paper display is well-suited for this embodiment, supporting full color images. The size of the digital display of this embodiment may be in the range of approximately 4 to 7 inches on the diagonal or more. The digital display may be powered by any one or more of the power options described herein.

Although the present disclosure has been described with reference to preferred embodiments, workers skilled in the art will recognize that changes may be made in form and detail without departing from the spirit and scope of the disclosure.

The invention claimed is:

1. A mountable combination holder assembly comprising:

A main body comprising:

a first cavity integrally formed therein and configured to hold a beverage container in a substantially upright position;

a second cavity integrally formed therein and configured to hold an accessory therein;

an opening in the main body supporting a digital display integrated therein and one or more transmitters/receivers within the main body operably connected to the digital display and positioned within an interior of the main body behind the digital display, wherein the main body is mountable to a seat back with a surface of the main body configured for mounting to at least one seat back.

2. The mountable combination holder assembly of claim 1, wherein the digital display comprises an e-paper based display.

3. The mountable combination holder assembly of claim 1, wherein the main body is a molded plastic main body.

4. The mountable combination holder assembly of claim 1, wherein the one or more transmitters/receivers comprise an RF receiver, an IR receiver, or a combination thereof.

5. The mountable combination holder assembly of claim 1, wherein the digital display is positioned on an upper surface of the main body.

6. The mountable combination holder assembly of claim 5 wherein the first and second cavities are also positioned on the top surface of the main body.

* * * * *